US006651530B2

(12) United States Patent
Pettigrew et al.

(10) Patent No.: US 6,651,530 B2
(45) Date of Patent: Nov. 25, 2003

(54) CUSTOM BUTTON SYSTEM AND METHOD FOR IDENTIFYING A FIBER FROM WHICH AN ASSOCIATED ARTICLE OF APPAREL IS MANUFACTURED

(76) Inventors: Victoria I. Pettigrew, 18640 Castle Lake Dr., Morgan Hill, CA (US) 95037; Stephen H. Pettigrew, 18640 Castle Lake Dr., Morgan Hill, CA (US) 95037

( * ) Notice: Subject to any disclaimer, the term of this patent is extended or adjusted under 35 U.S.C. 154(b) by 0 days.

(21) Appl. No.: 10/123,029

(22) Filed: Apr. 15, 2002

(65) Prior Publication Data

US 2003/0192406 A1 Oct. 16, 2003

(51) Int. Cl.[7] ..... A44B 1/08
(52) U.S. Cl. ..... 79/1; 24/114.9
(58) Field of Search ..... 79/1; 24/114.9

(56) References Cited

U.S. PATENT DOCUMENTS 1,881,038 A * 10/1932 Whitehouse ..... 264/266
1,920,120 A * 7/1933 Woodruff ..... 264/74
2,087,470 A * 7/1937 Davidson et al. ..... 264/161
2,306,587 A * 12/1942 Broderson ..... 40/315
3,211,817 A * 10/1965 Sucher ..... 264/108
3,638,334 A * 2/1972 Malikowski ..... 434/260
3,997,052 A * 12/1976 Eddy et al. ..... 206/348
6,450,089 B2 * 9/2002 Ackley ..... 101/38.1
2003/0006324 A1 * 1/2003 Pettigrew et al. ..... 241/24.19

* cited by examiner

*Primary Examiner*—William Hong
(74) *Attorney, Agent, or Firm*—Silicon Valley IP Group, PC; Kevin J. Zilka

(57) ABSTRACT

A button system and method of manufacturing the same are provided for identifying fiber from which an article of apparel is manufactured. Initially, an article of apparel manufactured with a predetermined fiber is identified. Next, indicia indicative of the predetermined fiber is selected. Next, at least one button is manufactured with the indicia thereon for identifying the fiber from which the article of apparel is manufactured.

10 Claims, 5 Drawing Sheets

CUSTOM BUTTON SYSTEM AND METHOD FOR IDENTIFYING A FIBER FROM WHICH AN ASSOCIATED ARTICLE OF APPAREL IS MANUFACTURED

FIELD OF THE INVENTION

The present invention relates to apparel, and more particularly to buttons for apparel.

BACKGROUND OF THE INVENTION

In conventional spinning practice, single fibers are spun and used as basic building blocks in the manufacture of the more complex fiber structures. Prior to the spinning process, fibers, which can be of natural or synthetic origin, are processed using various steps including, but not limited to carding, gilling, combing, drawing and roving. Such fibers may be extracted from various animals (i.e. alpacas, llamas, dogs, cats, etc.).

The prepared fiber is then creeled in a spinning frame where it is subjected first to a draft, or attenuation, by which the linear density of the fiber is reduced to a required level, and is then twisted with an amount of twist which depends upon the weight of the fiber and its intended use. The spinning operation is normally carried out on a machine such as a ringframe, a cap-frame or a flyer-frame, in which the rotation of a spindle serves to both insert twist into the fiber and to wind the fiber onto a package carried on the spindle.

At this point, the fiber is ready for being further processed and/or used to create articles of apparel and other consumer goods. Conventionally, buttons are secured to the apparel for securing a shirt, sweater, pants, etc. Unfortunately, such buttons are often plain and do not reflect the fiber from which the associated article of apparel is made.

DISCLOSURE OF THE INVENTION

A button system and method of manufacturing the same are provided for identifying fiber from which an article of apparel is manufactured. Initially, an article of apparel manufactured with a predetermined fiber is identified. Next, indicia indicative of the predetermined fiber is selected. Next, at least one button is manufactured with the indicia thereon for identifying the fiber from which the article of apparel is manufactured.

In one embodiment, the indicia indicative of the predetermined fiber may be selected utilizing a computer. Moreover, a plurality of indicia may be displayed utilizing the computer so that a user may select the same. As an option, the indicia may be printed utilizing a printer coupled to the computer.

In another embodiment, each button may be cut from a flexible rectangular sheet. As an option, the ink of each button may be dried for at least 24 hours prior to the button being cut from the sheet.

In still another embodiment, each button may be manufactured utilizing shrink plastic for being baked during the manufacturing process. Moreover, an ink used to print the indicia may be protected by applying a sealer to the button.

In still yet another embodiment, the indicia may include a picture of a type (i.e. species, breed, etc.) of animal from which the fiber originated.

These and other advantages of the present invention will become apparent upon reading the following detailed description and studying the various figures of the drawings.

BRIEF DESCRIPTION OF THE DRAWINGS

The foregoing and other aspects and advantages are better understood from the following detailed description of a preferred embodiment of the invention with reference to the drawings.

DESCRIPTION OF THE PREFERRED EMBODIMENTS

Figure 1:
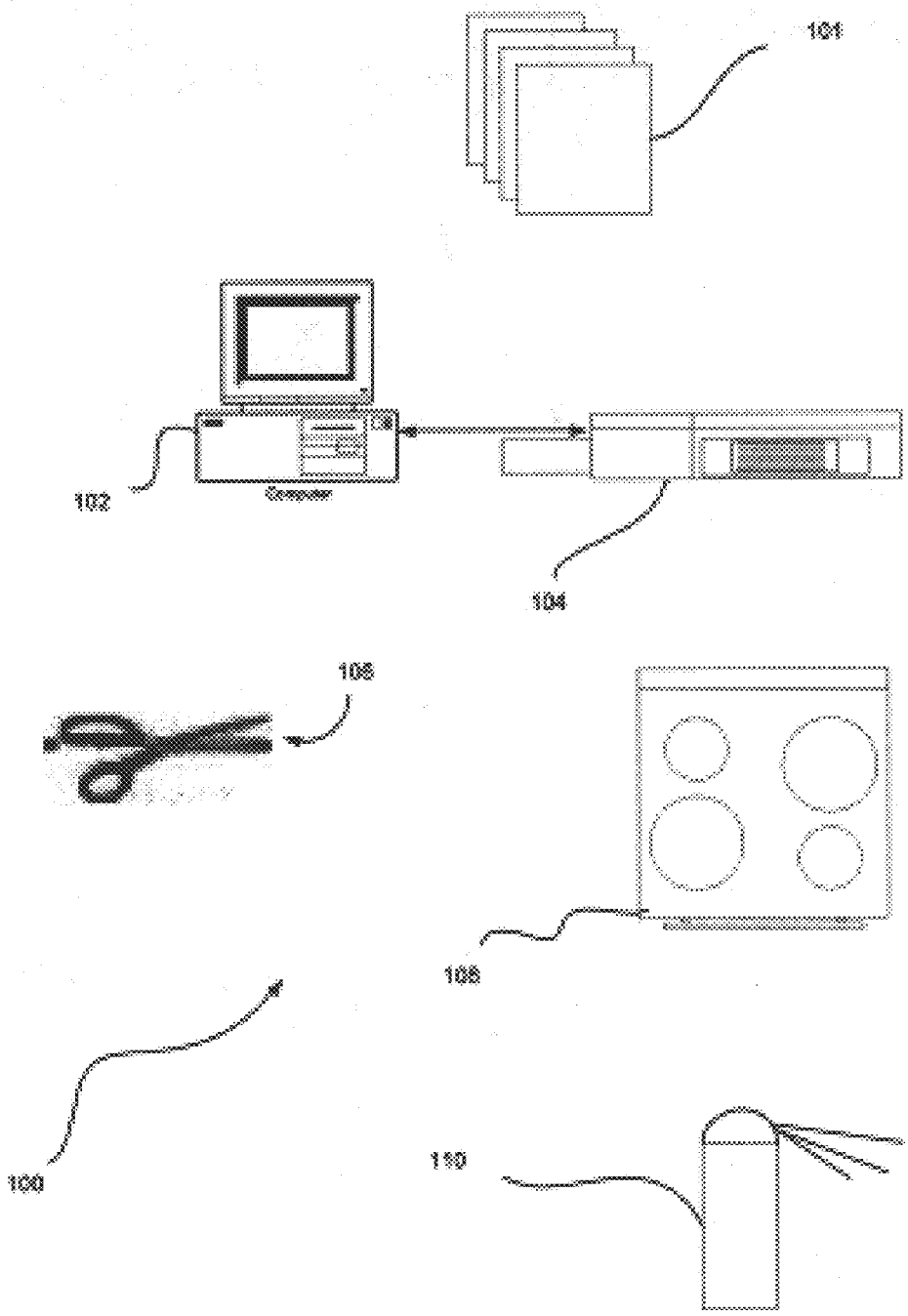
FIG. 1 illustrates the various components provided to manufacture a button system capable of identifying fiber from which an article of apparel is manufactured.

FIG. 1 illustrates the various components 100 provided to manufacture a button system capable of identifying fiber from which an article of apparel is made. As shown, a computer 102 and a printer 104 are provided. More information regarding an exemplary embodiment of such computer 102 will be set forth during reference to FIG. 2.

Also included is a plurality of transparent flexible rectangular sheets 101 that are capable of being received in a conventional ink jet, laser, or another computer-compatible printer. See, for example, computer 102 and printer 104. Ideally, such sheets are each constructed from shrink plastic which is capable of being shrunk when heated. One exemplary type of shrink plastic includes SUPER COLOR™ shrink plastic manufactured by MICRO FORMAT™, Inc.

Still yet, an oven 108 is provided for baking or otherwise heating the sheets 101 for shrinking purposes. For reasons that will soon become apparent, scissors 106 are provided which are capable of cutting the sheets 101.

A sealant 110 is further provided. Such sealant may, in one embodiment, be dispensed using an aerosol can. Of course, any dispensing medium may be employed. In one embodiment, the sealant 110 may include PLAID™ indoor thick gloss sealer, ACCENT™ CRYSTAL GAZE™ sealer, a clear coat acrylic sealer, or any other type of sealer that is capable of protecting ink of the type used by the printer 104.

Figure 2:
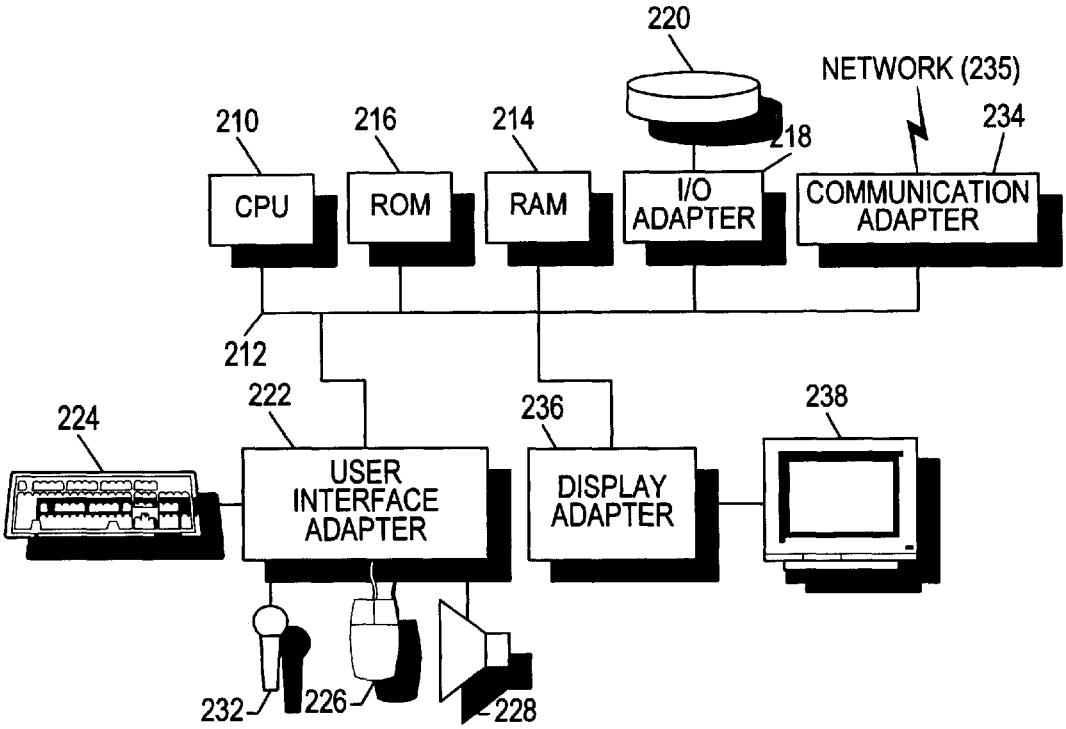
FIG. 2 shows a representative computer of FIG. 1, in accordance with one embodiment.

FIG. 2 shows a representative computer 102 of FIG. 1, in accordance with one embodiment. Such figure illustrates a typical hardware configuration of a computer in accordance with a preferred embodiment having a central processing unit 210, such as a microprocessor, and a number of other units interconnected via a system bus 212.

The computer shown in FIG. 2 includes a Random Access Memory (RAM) 214, Read Only Memory (ROM) 216, an I/O adapter 218 for connecting peripheral devices such as disk storage units 220 to the bus 212, a user interface adapter 222 for connecting a keyboard 224, a mouse 226, a speaker 228, a microphone 232, and/or other user interface devices such as a touch screen (not shown) to the bus 212, communication adapter 234 for connecting the computer to a communication network 235 (e.g., a data processing network) and a display adapter 236 for connecting the bus 212 to a display device 238.

The computer may have resident thereon an operating system such as the Microsoft® Windows® NT or Windows®/95 Operating System (OS), the IBM® OS/2® operating system, the MAC® OS, or UNIX™ operating system. It will be appreciated that a preferred embodiment may also be implemented on platforms and operating systems other than those mentioned. A preferred embodiment may be written using JAVA, C, and/or C++ language, or other programming languages, along with an object oriented programming methodology. Object oriented programming (OOP) has become increasingly used to develop complex applications.

Figure 3:
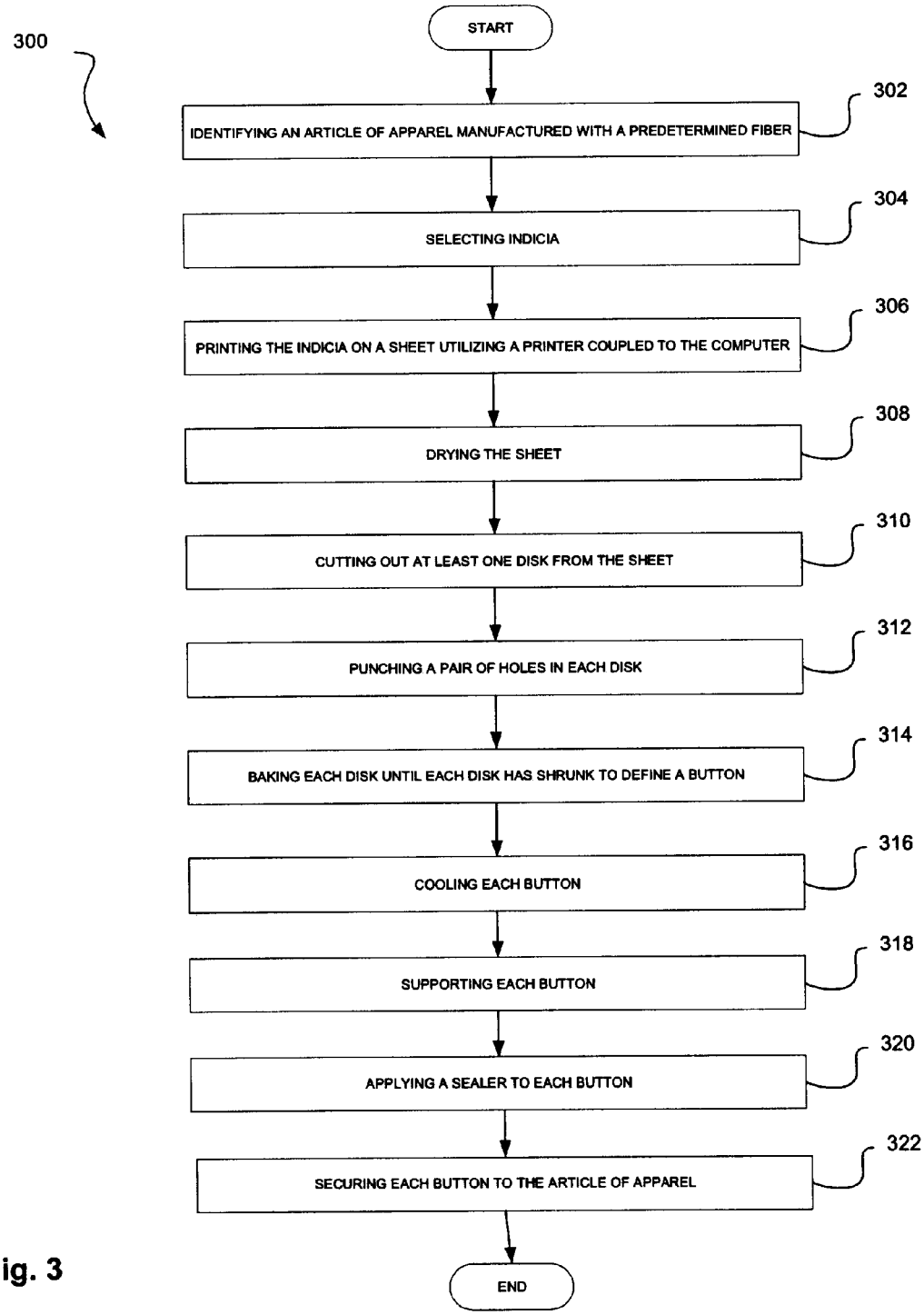
FIG. 3 illustrates a method for manufacturing a button capable of identifying fiber from which an article of apparel is manufactured.

FIG. 3 illustrates a method 300 of manufacturing a button for identifying fiber from which an article of apparel is manufactured. In one embodiment, the method 300 may be implemented utilizing the components of FIGS. 1 and 2. Of course, however, the present method 300 may be implemented using any desired components in any desired commercial or non-commercial environment.

Initially, in operation 302, an article of apparel manufactured with a predetermined fiber is identified. In particular, the fiber from which the article of apparel is manufactured is identified. In the context of the present description, such article of apparel may include pants, shorts, a shirt, a sweater, a jacket, or another article of apparel capable of being manufactured from fiber and having a button attached thereto. Further, fiber may include any natural fiber extracted from an animal (i.e. alpaca, llama, dog, cat, etc.).

Next, in operation 304, indicia indicative of the predetermined fiber is selected utilizing a computer (see, for example, computer 102 of FIG. 1). In one embodiment, this may be accomplished utilizing a graphical user interface.

Figure 4:
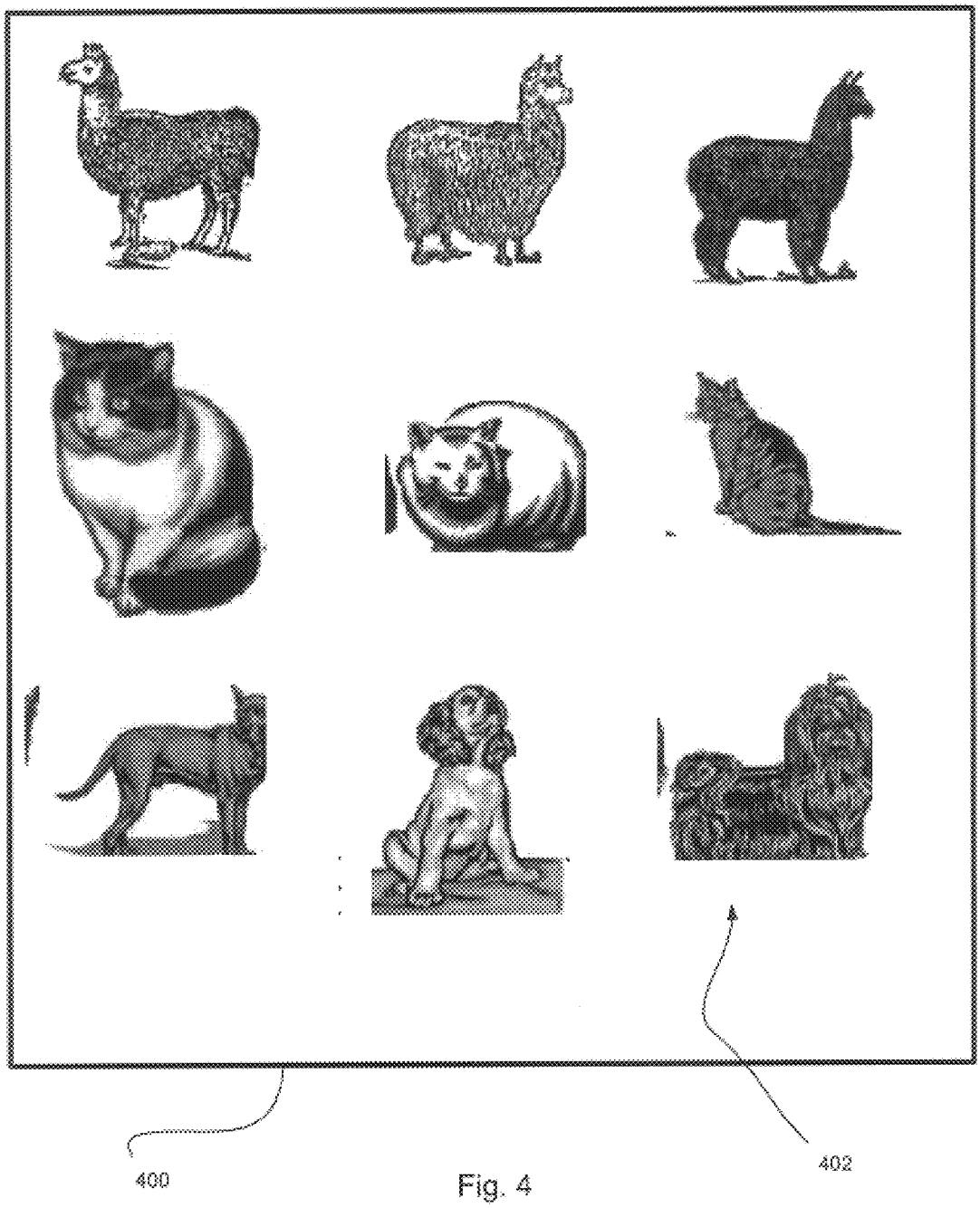
FIG. 4 illustrates an exemplary graphical user interface with which a user may select indicia.

FIG. 4 illustrates an exemplary graphical user interface 400 with which a user may select indicia 402. As shown, each indicia 402 may include a picture of a type (i.e. species, breed, color, size, etc.) of animal from which the fiber originated. While pictures are shown, it should be noted that textual indicia may also be used to identify the animal type. For example, a pet name or a generic animal type identifier may be used. Further, the indicia may be organized in various folders for facilitating the retrieval and selection thereof.

In an alternate embodiment, an electronic copy of a picture (i.e. .gif, .jpeg, etc.) of a particular animal may be inputted to the computer for being used as indicia. Still yet, various alphanumeric characters may be used to identify the process by which the article of apparel and/or fiber was manufactured (i.e. "HAND SPUN, HAND KNIT", etc.), or the person responsible for such manufacture.

With reference again to FIG. 3, in operation 306, at least one circular or otherwise shaped outline is printed on one of the transparent flexible rectangular sheets utilizing a printer (see, for example, printer 104 of FIG. 1) coupled to the computer which applies ink to the sheet. It should be noted that the outlines may be shaped in any desired manner that may function as a button. For reasons that will soon become apparent, the indicia may be printed within each circular outline on a first side of each sheet.

It should be noted that a mirror image of the indicia is printed on the button. As will soon become apparent, this is important so that the ink will be facing an article of apparel and thus better protected against inadvertent removal during use.

Next, in operation 308, the sheet is dried for at least 24 hours to prevent smearing of the ink when the sheets are cut. Of course, any effective drying time period may be employed. At least one circular disk defined by the at least one circular outline is then cut and removed from the sheet. Note operation 310. This may be accomplished utilizing scissors (see, for example, scissors 106 of FIG. 1).

Next, a pair of holes is punched in each circular button, as indicated in operation 312. In one embodiment, such holes may flank a center of the circular disk. As an option, a hole-punch device may be used for carrying out this operation.

At this point, each disk may be baked until each disk has shrunk to define a button. See operation 314. This may be accomplished using a conventional or modified oven (see, for example, oven 108 of FIG. 1). This operation serves to reduce, or shrink, the size of the disks.

A duration of the bake operation may be determined as a function of the desired size of the resultant button (i.e. ½ the size). In one embodiment, a button with a 1⅞" approximate diameter (large) or ⅞" approximate diameter (smaller) may be manufactured.

Once the desired size is met, each button is cooled. Note operation 316. In operation 318, each button may be supported utilizing at least one rod, for reasons that will soon become apparent. This supporting may be such that each button resides in a horizontal plane elevated from a support surface. In one embodiment, this may be accomplished using toothpicks as rods. For example, first ends of the toothpicks may be inserted into the aforementioned holes of a button. Further, second ends of the toothpicks may be inserted into a putty or the like on the supporting surface.

Thereafter, a sealer is applied to the first side of each button for protecting the ink. See operation 320. Operation 320 is important since inks used by conventional printers are often easily removed (i.e. by scratching, etc.) from smooth surfaces such as those of the transparent sheets.

Thus, it is now apparent that it is important that each button reside in a horizontal plane elevated from a support surface so that the sealant does not accumulate about a perimeter of the button that may otherwise rest on the supporting surface.

Each button may then be secured to the article of apparel with thread, as indicated in operation 322. The securement is such that the ink and sealant faces the article of apparel. Thus, the mirror image of the indicia is viewed appropriately when looking at a front of the article of apparel. In use, the indicia of each button serves to effectively identify the fiber from which the article of apparel is made.

Figure 5:
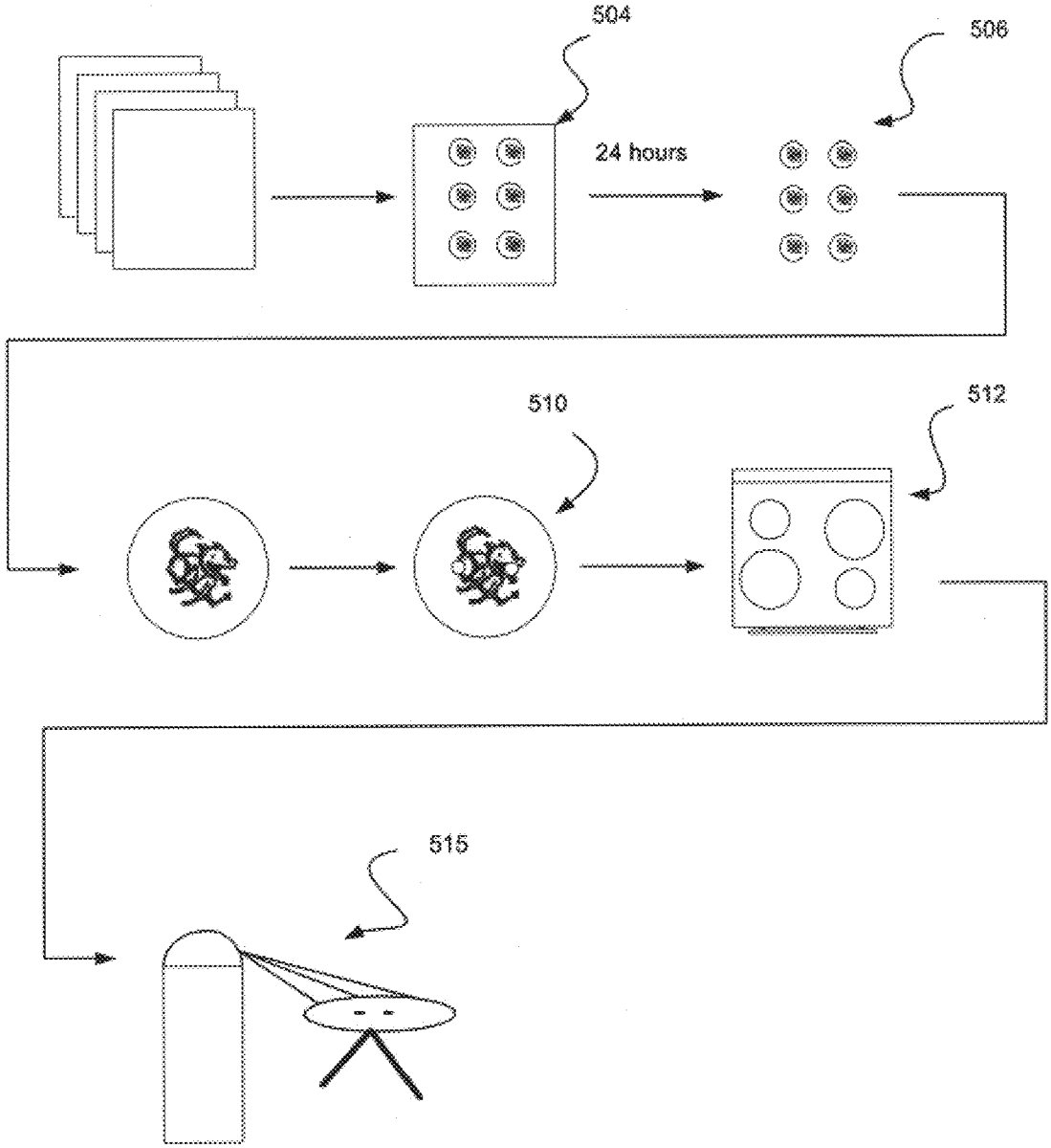
FIG. 5 diagrammatically shows the process operations of the method of FIG. 3.

FIG. 5 diagrammatically shows the process operations of the method 300 of FIG. 3. As shown, in operation 504, the indicia is printed within each circular outline on a first side of each sheet. Operation 506 shows the manner in which the disks are removed by cutting along the outlines of the sheet.

Next, in operation 510, the holes are punched, after which the disks are baked in a manner discussed previously. Note operation 512. Finally, in operation 515, sealant is applied to the resultant buttons for protection purposes.

While various embodiments have been described above, it should be understood that they have been presented by way of example only, and not limitation. Thus, the breadth and scope of a preferred embodiment should not be limited by any of the above described exemplary embodiments, but should be defined only in accordance with the following claims and their equivalents.

What is claimed is:

1. A method for manufacturing buttons adapted for identifying fiber from which an article of apparel is manufactured, comprising:

identifying an article of apparel manufactured with a predetermined fiber;

selecting indicia indicative of the predetermined fiber utilizing a computer, the indicia including a picture of a type of animal from which the fiber originated;

printing at least one circular outline on a transparent flexible rectangular sheet utilizing a printer coupled to the computer which applies ink to the sheet, the indicia being printed within each circular outline on a first side of each sheet, and each sheet being constructed from shrink plastic;

drying the sheet for at least 24 hours;

cutting out at least one circular disk defined by the at least one circular outline from the sheet;

punching a pair of holes in each disk, the holes flanking a center of the associated disk;

baking each disk until each disk has shrunk to define a button;

cooling each button;

supporting each button utilizing at least one rod such that each button resides in a horizontal plane elevated from a support surface;

applying a sealer to the first side of each button for protecting the ink; and securing each button to the article of apparel;

wherein the indicia of each button identifies the fiber from which the article of apparel is manufactured.

2. A method for manufacturing buttons adapted for identifying fiber from which an article of apparel is manufactured, comprising:

identifying an article of apparel manufactured with a predetermined fiber;

selecting indicia indicative of the predetermined fiber; and manufacturing at least one button with the indicia thereon for identifying the fiber from which the article of apparel is manufactured.

3. The method as recited in claim 2, wherein the indicia indicative of the predetermined fiber is selected utilizing a computer.

4. The method as recited in claim 3, wherein a plurality of indicia is displayed utilizing the computer.

5. The method as recited in claim 3, wherein the indicia is printed utilizing a printer coupled to the computer.

6. The method as recited in claim 5, wherein each button is cut from a flexible rectangular sheet.

7. The method as recited in claim 6, wherein each button is dried for at least 24 hours prior to being cut.

8. The method as recited in claim 5, wherein an ink used to print the indicia is protected by applying a sealer to the button.

9. The method as recited in claim 2, wherein each button is manufactured utilizing shrink plastic.

10. The method as recited in claim 2, wherein the indicia includes a picture of a type of animal from which the fiber originated.

* * * * *